US005155982A

United States Patent [19]

Boek et al.

[11] Patent Number: 5,155,982

[45] Date of Patent: Oct. 20, 1992

[54] PACKING MACHINE

[75] Inventors: Alfred Boek, Erftstadt-Lechenich; Peter Galden, Cologne, both of Fed. Rep. of Germany

[73] Assignee: RMO Systempack GmbH Verpackungssysteme, Fed. Rep. of Germany

[21] Appl. No.: 705,986

[22] Filed: May 28, 1991

[51] Int. Cl.[5] ..... B65B 13/22

[52] U.S. Cl. ..... 53/589; 100/29

[58] Field of Search ..... 53/589, 582; 100/25, 100/29, 32, 33 PB

[56] References Cited

U.S. PATENT DOCUMENTS 4,559,767 12/1985 Takami ..... 53/589
4,605,456 8/1986 Annis ..... 53/589 X
4,724,659 2/1988 Mori ..... 53/589

FOREIGN PATENT DOCUMENTS 885371 12/1961 United Kingdom ..... 53/589

*Primary Examiner*—John Sipos

*Attorney, Agent, or Firm*—Diller, Ramik & Wight

[57] ABSTRACT

The packing machine is provided for laying band (11) around goods (10) to be packed, with the band being advanced by a drive roller (42). After a complete loop has been generated by the band (11), the band is reversed by a drive roller (43) in a reverse movement to be performed first at high speed. Then, the band (11) is tensioned by further reverse movement at a low speed. For the fast movement, there is provided a first drive branch (70) which alwys drives both drive rollers (42,43) in common. A second drive branch (71), including a gearing (80), is provided for tensioning the band (11). A gearing member (81) of the gearing (80) is held fast by a stationary holding coupling (86). If the tension exceeds the braking moment provided by the holding coupling (86), the previously retained gearing member (81) is rotated. This rotation is detected by a sensor (88) which then initiates termination of the tensioning. Said holding coupling (86) is an electromagnetic brake adapted for electrically setting the holding moment within wide limits.

1 Claim, 7 Drawing Sheets

Figure 1:
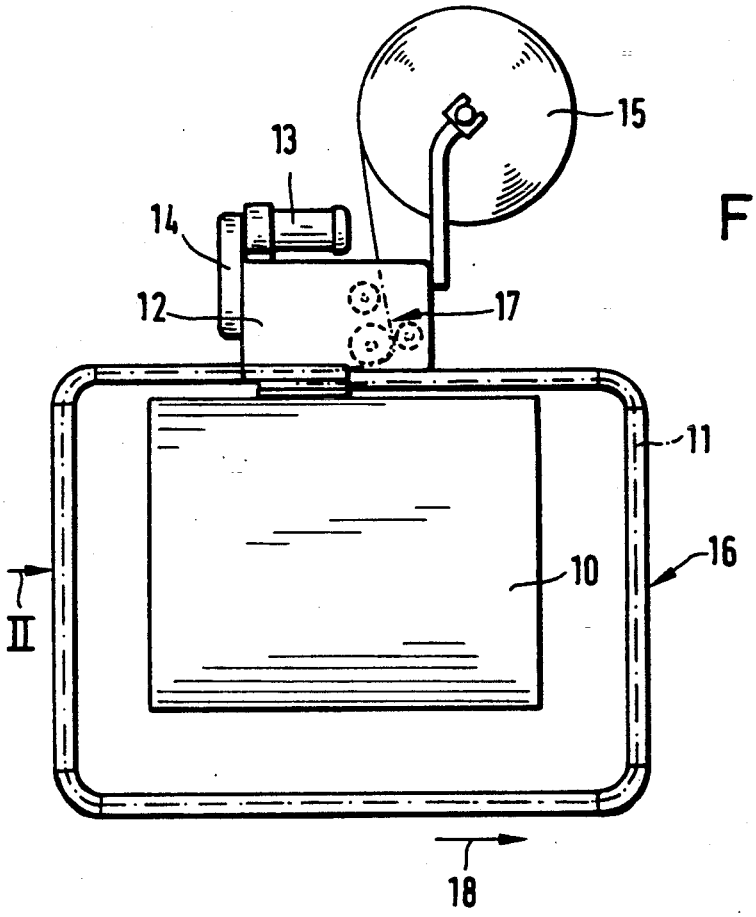

FIG.6
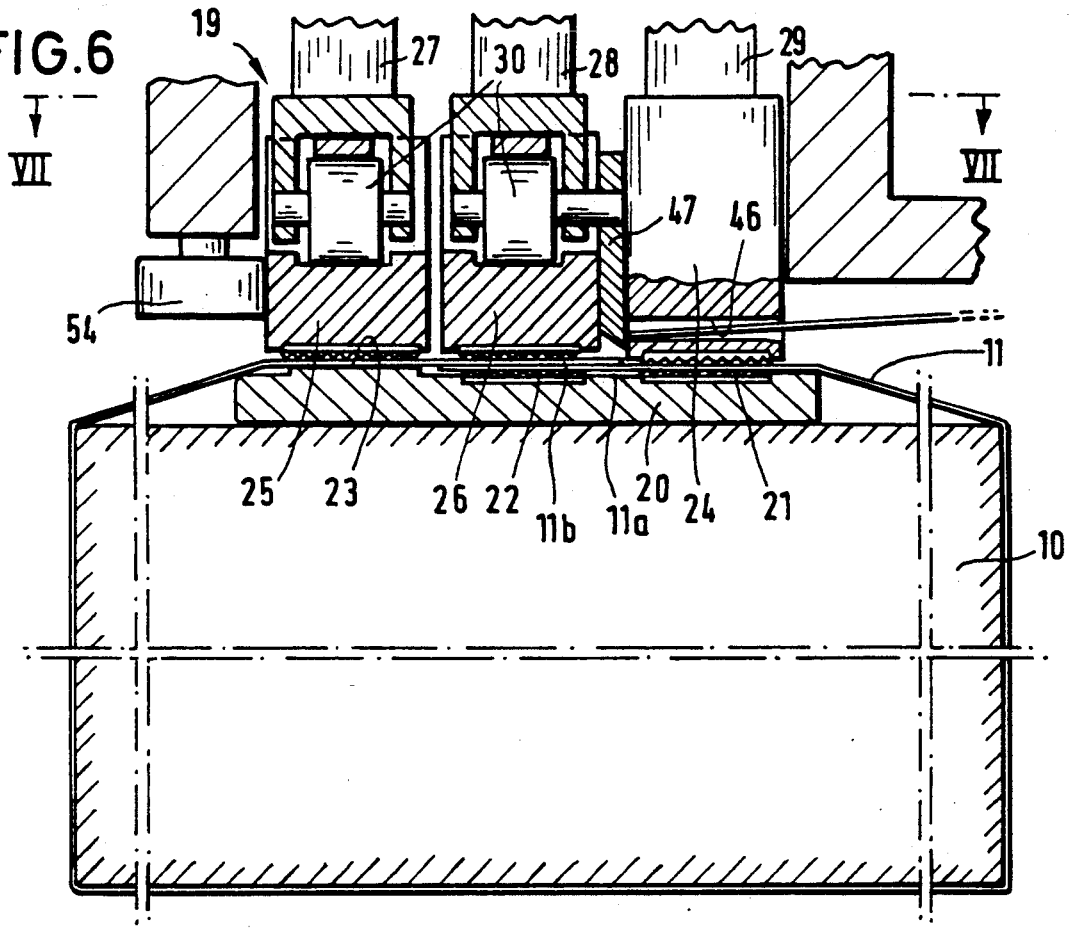
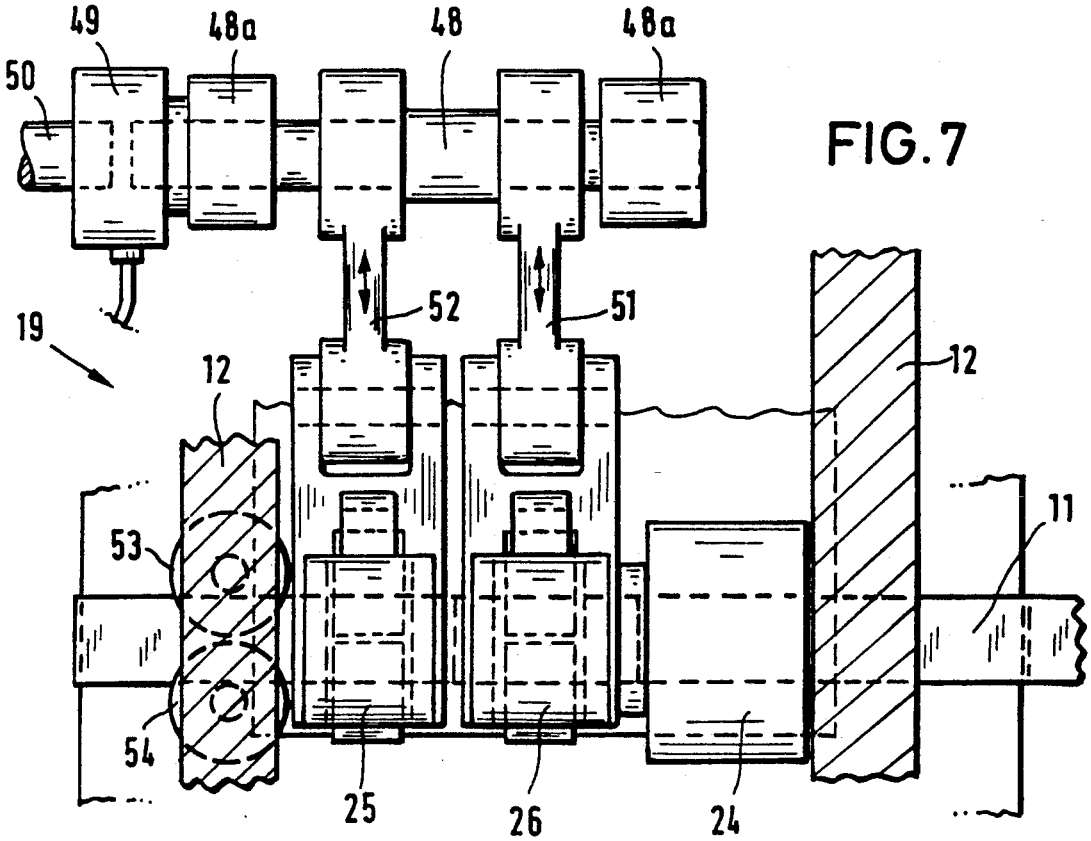
FIG.7

PACKING MACHINE

The invention is directed to a packing machine for tying a band around goods to be packed.

It is a known practice to enclose goods destined for packing, such as cardboard boxes, pallet loads, stacks of newspapers and the like, with bands of thermoplastic plastics material. To this purpose, packing machines are used for laying the band, supplied from a supply drum, in a closed loop around the goods to be packed, with the ends of the loop overlapping each other. After advancing the band in a guide channel, the leading end of the band is clamped tight. Then, the band is driven in reverse direction for tightening it around the pack or bale of goods, and finally the overlapping band portions are welded to each other. Since such packing machines shall be adapted for packing different kinds of goods which require different band tensions, it is suitable that a wide range the band tensions can be set in a simple manner. Thus, for instance, a pile of stones to be tied up with bands necessitates a considerably higher tension than relatively soft goods, e.g. cardboard boxes. In dependence of the to-be-packed goods, also the elasticity of the used band is subject to variation, which again requires that the band tension can be settable within a wide range.

In a packing machine known from CH-668 402 A5, the drive means includes two parallel drive branches or drive strings, each of them provided with a switchable coupling for allowing the drive branches to be switched on alternatively. The drive roller for driving the band is driven by the respective switched-on drive branch, and both of the drive branches generate different band speeds. For guiding the band around the goods to be packed, the drive motor is first driven in forward direction while the first drive branch, providing the higher rotational speed of the drive roller, is switched on. When a closed band loop has been generated, the drive motor is reversed, i.e. is switched to reverse motion whereby the first drive branch causes return movement of the band. When this return movement becomes slower due to the increasing resistance of the band, the device is switched over from the first to the second drive branch which then effects the tensioning of the band. A disadvantage of this packing machine consists in that a reversible drive motor is needed and that, when reversing the direction of rotation, larger masses have to be slowed down and then accelerated again.

In the packing machine disclosed in CH 662 791 A5, no reversal of the drive motor is necessitated. The roller for driving the band can be driven in advance direction by a first drive branch and in reverse direction by a reversing second drive branch. Both drive branches can be actuated by a respective coupling means. In this machine, no switching between fast and slow speeds is possible.

It is an object of the invention to provide a packing machine which, during reverse movement of the band, can be switched from fast band movement to slow band movement and which is driven by a non-reversible motor so that, when switching the running direction of the band, no masses except for the mass of the band have to be braked and accelerated.

In the packing machine of the invention, the drive means comprises two different drive rollers, one of them provided exclusively for advance movement and the other one being provided exclusively for return movement. Both of the drive rollers are driven in common by the respective switched-on drive branch. In dependence of the intended drive direction of the band, either the one or the other drive roller is brought into contact with the band. When changing the band drive direction, none of the two drive rollers change their direction of rotation. There is merely an exchange of the drive roller engaging the band. This offers the advantage that, for changing the direction of the band, no masses of the machine need be braked or accelerated so that reversal of directions is performed quickly and the working cycle of the machine can be carried out at high speed.

First, the packing machine lays the band around the goods to be packed by driving the band in advance direction. When the band loop has been completed, a reverse movement is initiated by moving the first drive roller away from the band and setting the second moving roller against the band. This return movement is performed by the same drive branch which carried out the advance movement before. Only when the band loop tightly encloses the packed goods, the return movement is switched from the first drive branch to the slower second drive branch which is used for tightening the band around the packed goods with the required band tension.

An embodiment of the invention will be described in greater detail hereunder with reference to the drawings.

Figure 2:
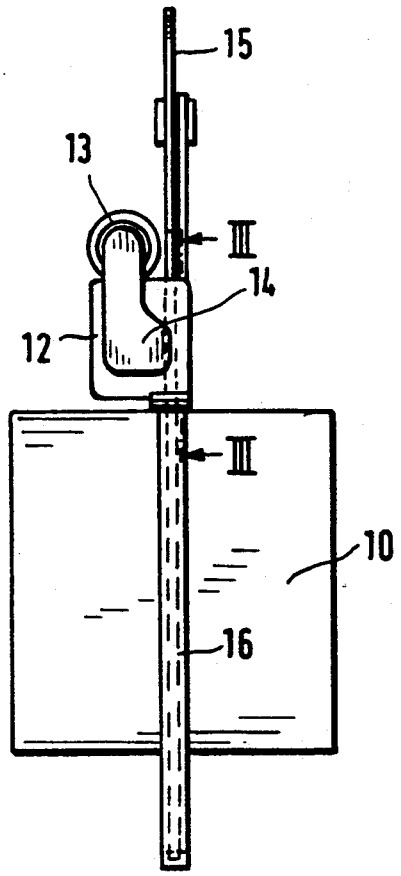
Figure 3:
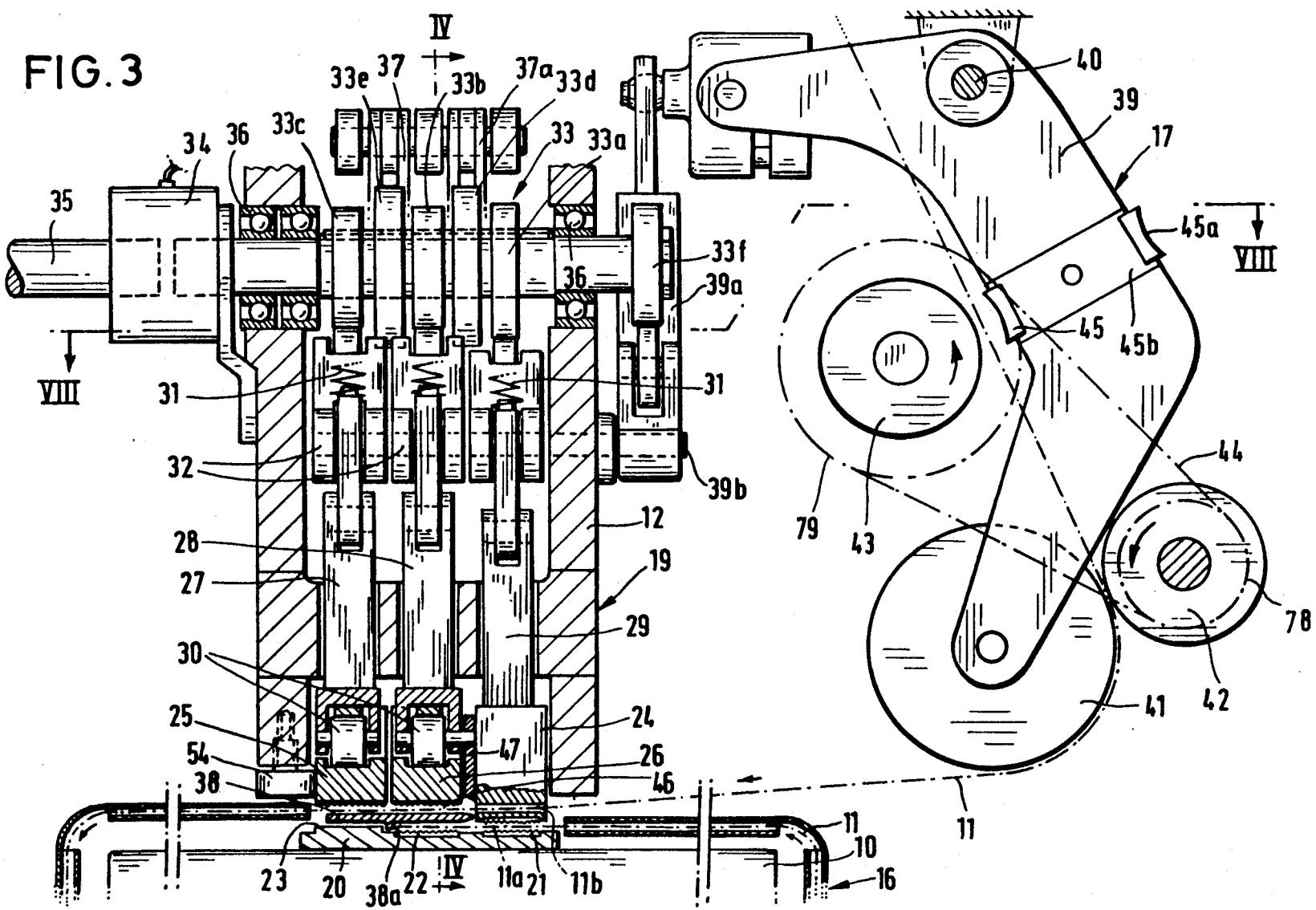
Figure 4:
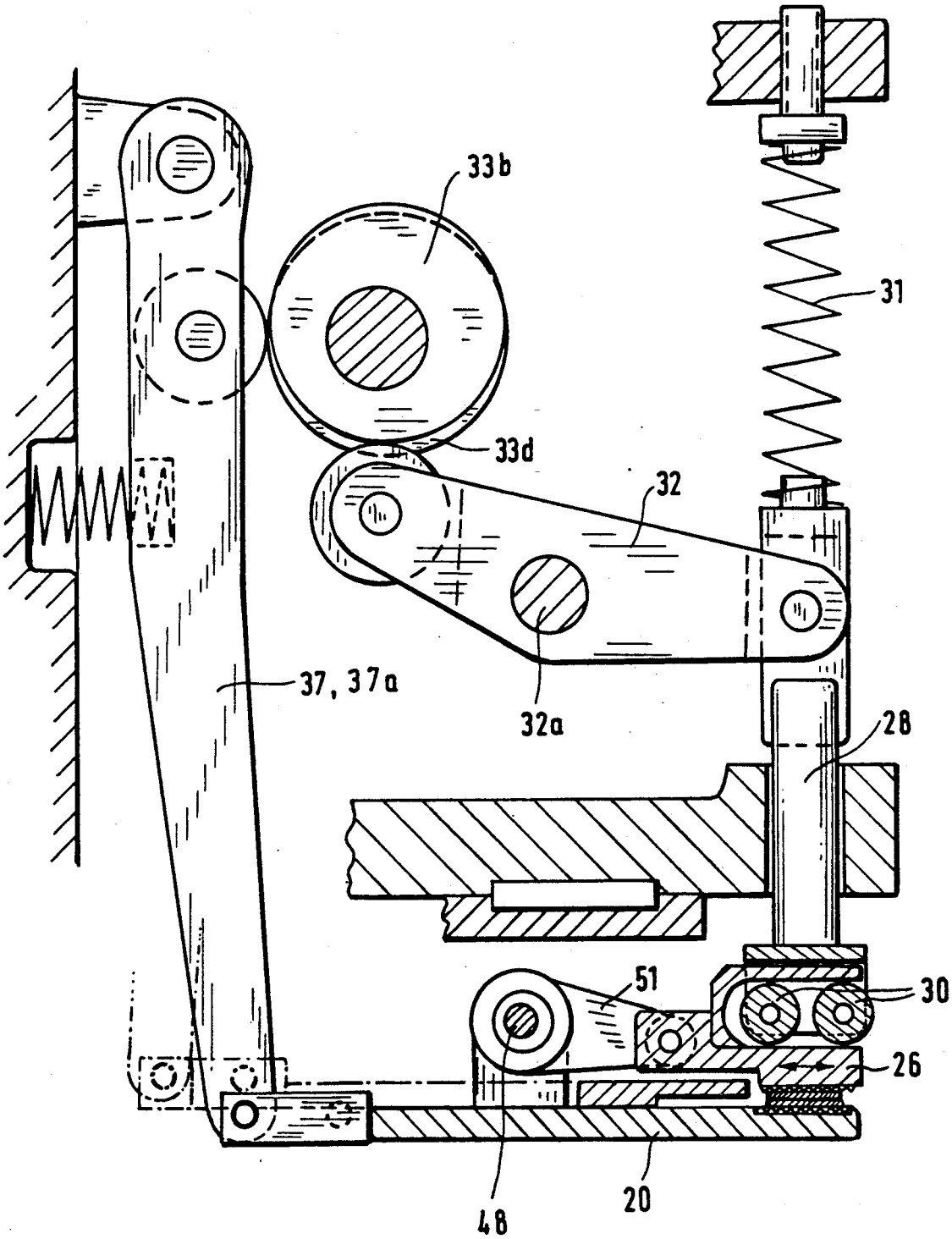
Figure 5:
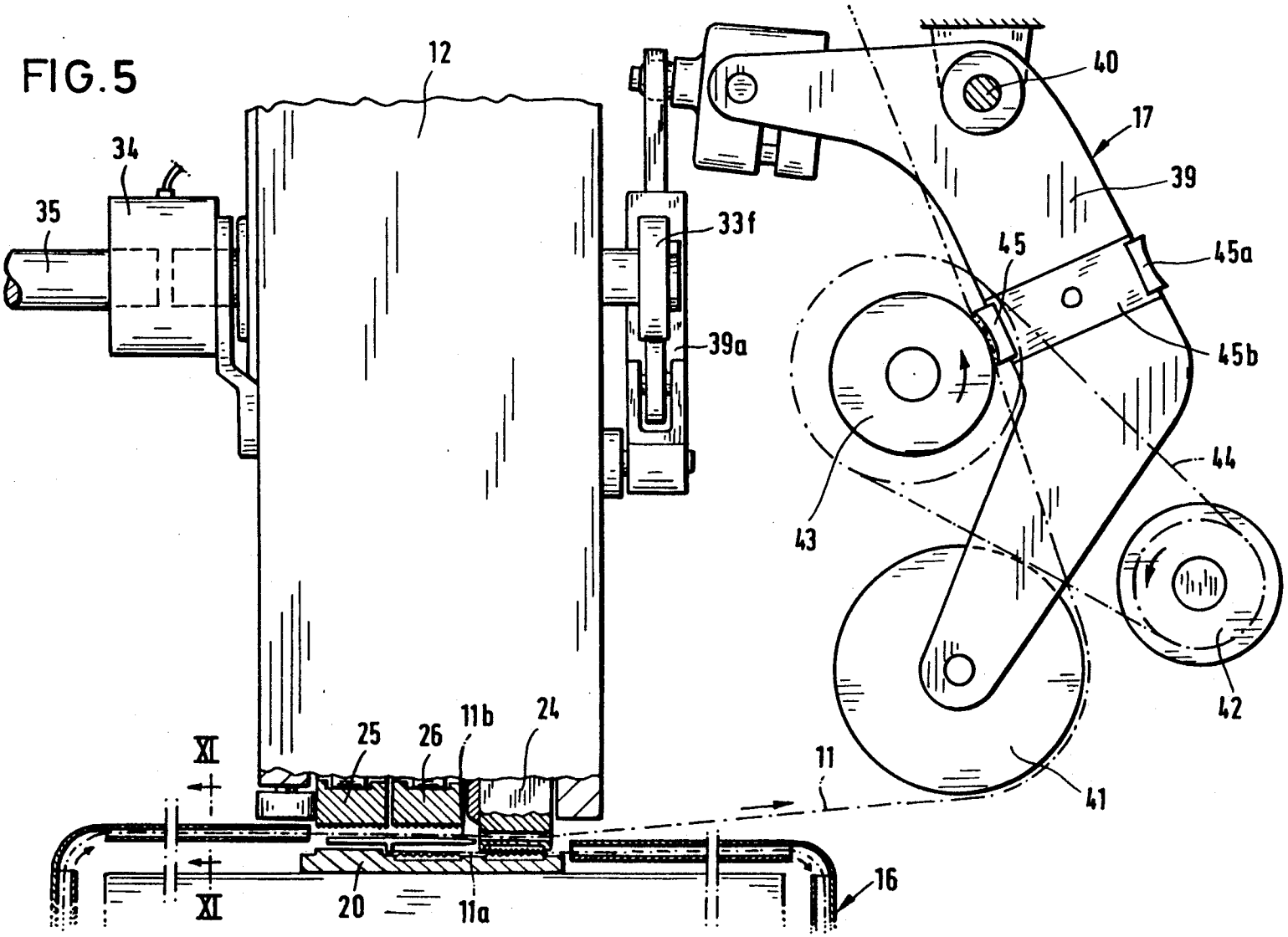
Figure 8:
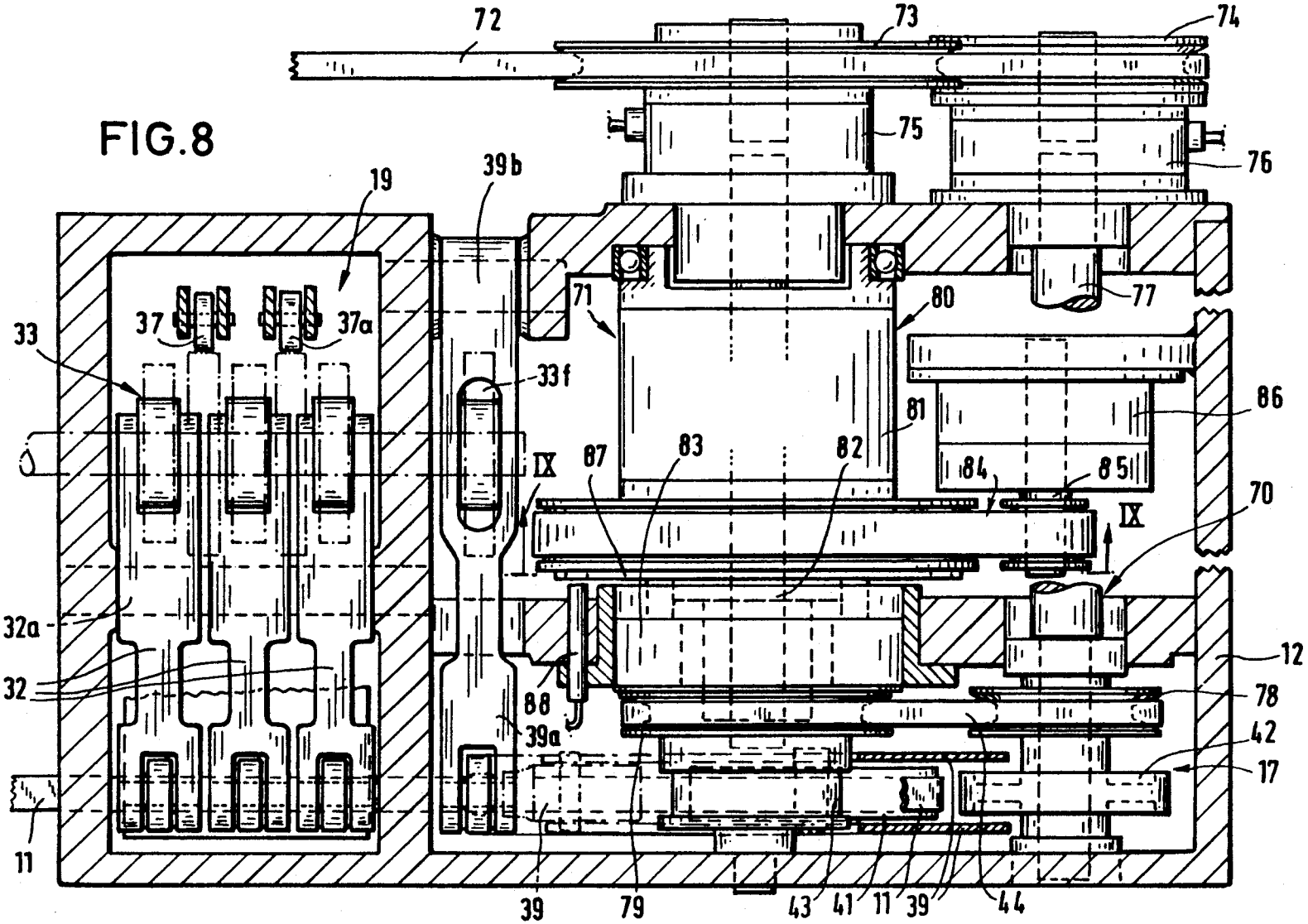
Figure 11:
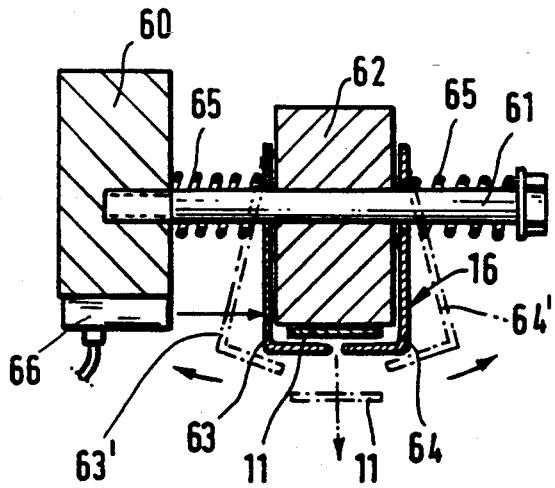
Figure 9:
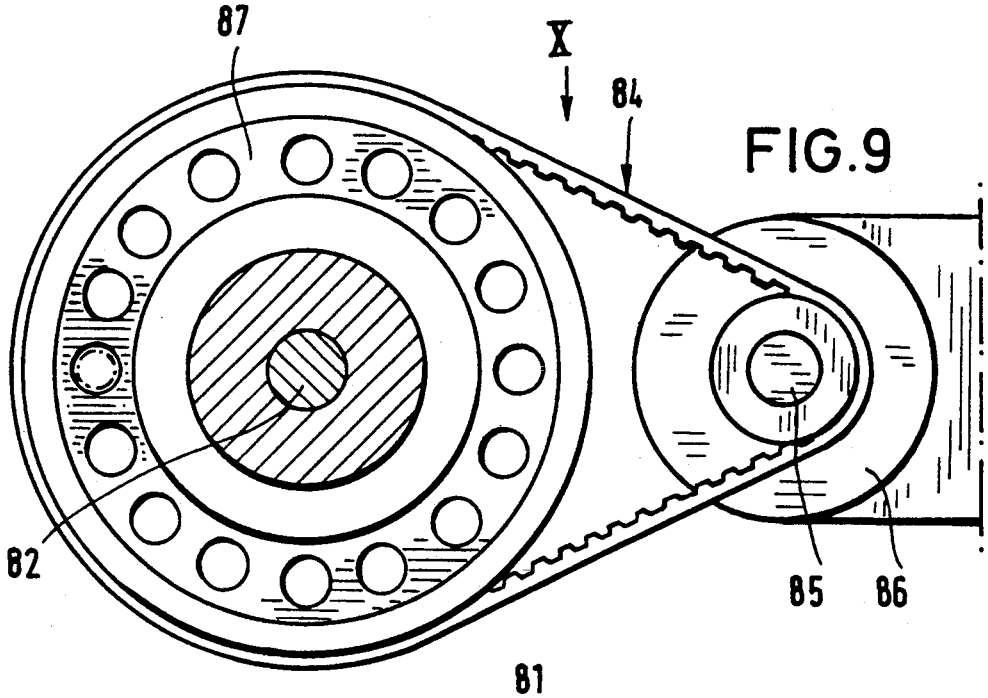
Figure 10:
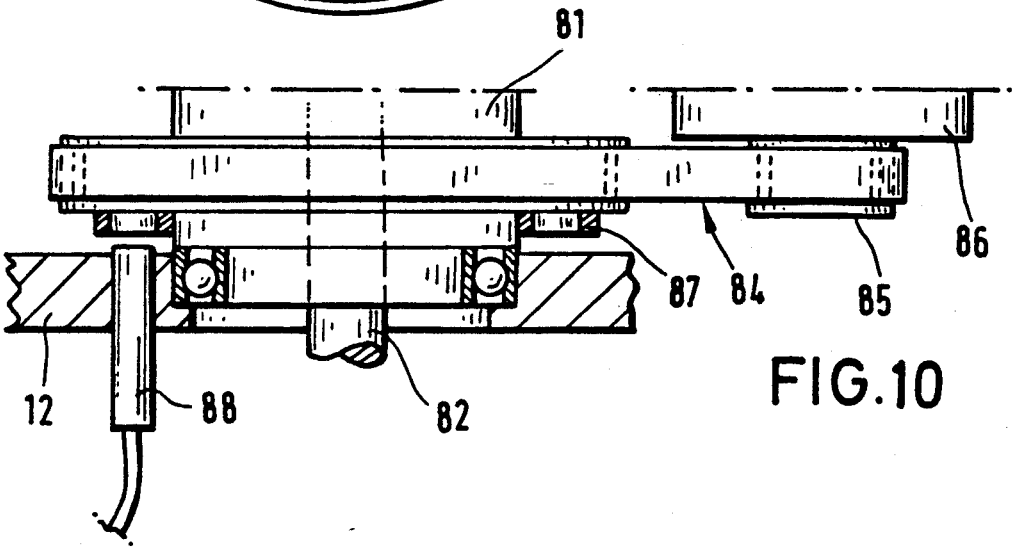

FIG. 1 is a schematic view of the packing machine,

FIG. 2 shows the packing machine from the direction of arrow II of FIG. 1, FIG. 3 is a vertical sectional view of the packing machine along the line III—III of FIG. 2, FIG. 4 is a sectional view along the line IV—IV of FIG. 3, FIG. 5 is a view of the machine during reverse movement, with parts of the machine broken away, FIG. 6 shows, at an enlarged scale and from the same perspective as in FIG. 3, the function of the clamping jaws and the oscillating jaw during the friction welding, FIG. 7 is a horizontal sectional view along the line VII—VII of FIG. 6, FIG. 8 is a sectional view along the line VIII—VIII of FIG. 3, FIG. 9 is a sectional view along the line IX—IX of FIG. 8, FIG. 10 is a plan view of the arrangement of FIG. 9 as seen from the direction of arrow X, and FIG. 11 is a sectional view along the line XI—XI of FIG. 5.

The device shown in FIG. 1 is provided for tightly wrapping a thermoplastic band 11 around goods 10 to be packed and for tying up said goods with the band. The device has a housing 12 with a drive motor 13 mounted thereon for driving the belt drive and the other parts of the device via a transmission 14 and various coupling means. An arm of housing 12 supports a band-supply drum 15 from which the band 11 is unwound.

The underside of housing 12 has a frame mounted thereon, forming a guide channel 16 surrounding the packed goods 10 at a distance. The band 11 is inserted, by a drive mechanism 17 arranged in housing 12, into this guide channel in such a manner that the band is moved in the direction of arrow 18 of FIG. 1 until a closed loop has been established in guide channel 16. Then, the band is pulled back by the drive mechanism whereby flaps are opened at the inner side of guide channel 16 and the band leaves the guide channel in inward direction. Thereupon, the band is held fast merely by the tensioning and connecting mechanism provided at the underside of housing 12 until the band tightly encloses the packed goods 10. Then, the ends of the band are connected to each other and the band is cut off from the band held on the supply drum.

FIGS. 3–7 show the tensioning and connecting mechanism 19 provided with an abutment 20 contacting the upper side of the packed goods 10. Said abutment is adapted to be moved transversely to the band and to be laterally withdrawn from under the band 11 after completion of the closing process. The abutment 20, as seen in longitudinal direction of the band, is provided successively with a corrugated holding face 21, a further corrugated holding face 22 and a raised smooth support face 23. Above holding face 21, there is arranged a vertically displaceable clamping jaw 24 whose underside is also corrugated for cooperation with holding face 21. Above support face 23, there is provided a further clamping jaw 25, again with a corrugated underside. The oscillating jaw 26, having a corrugated underside, is arranged above holding face 22. The clamping jaws 24,25 and the oscillating jaw 26 are vertically moved by rams 27,28,29 guided for vertical displacement, with the clamping jaw 25 and the oscillating jaw 26 being supported at ram 27 and 28 resp. by rollers 30 for performing horizontal movements transversely to the band.

Rams 27,28,29 are pressed down by a respective spring 31 and are moved by levers 32 supported on an axis and being controlled by a cam shaft 33. A cam disk **33*a* controls the vertical movement of clamping jaw 24, a cam disk 33*b* controls the vertical movement of oscillating jaw 26 and a cam disk 33*c* controls the vertical movement of clamping jaw 25. Cam shaft 33 is connected, through a coupling means 34, to a drive shaft 35 driven by motor 13 and is supported by bearings 36 of housing 12**.

Cam shaft 33 is provided with still further cam disks **33*d* and 33*e* for controlling, through a respective lever 37 or 37*a* pivoted to the housing, the transverse movements of abutment 20 and of an abutment plate 38 movable on abutment 20**.

Finally, cam shaft 33 has provided thereon still another cam disk **33*f* for controlling, by an auxiliary lever 39*a* pivoted at 39*b*, a lever 39 of drive mechanism 17. Said lever 39 is pivoted on a bearing 40 of housing 12 and has its end provided with a freely rotatable presser roller 41 for guiding therearound the band 11 supplied from supply drum 15. Two drive rollers 42 and 43 are supported on the housing, being driven in common and coupled by a drive belt 44** in such a manner that they rotate in an identical sense of rotation.

Lever 39 is controlled by cam disk **33*f* for movement into two different positions. In one position, lever 39 presses band 11 against drive roller 42 by use of presser roller 41, and in the other position, lever 39 presses band 11 against drive roller 43 by use of a pressing jaw 45. Said pressing jaw 45 is mounted, together with a substitute pressing jaw 45*a*, on a pivotable pressing-jaw carrier 45*b*. In the first position of lever 39, the band is driven by drive roller 42 towards the tensioning and connecting mechanism 19, and in the second position, the band is pulled by drive roller 43** in the opposite direction and thus is tensioned.

While being advanced by drive roller 42, the band passes through a channel 46 of clamping jaw 24 and subsequently runs through guide channel 16. Then, the leading band portion **11*a* is returned to the tensioning and connecting mechanism 19 while abutting against an abutment portion 38*a* of abutment plate 38 (FIG. 3). This abutment of the leading band portion against abutment plate 38 switches the coupling means 34 into its active state by actuation of a swich means (not shown). First, clamping jaw 24 is moved downwards by cam disk 33*a* so that the leading band portion 11*a* is clamped between clamping jaw 24 and holding face 21. Further, lever 39 is switched into its alternative position so that the band is driven in return direction by drive roller 43 (FIG. 5). Now, the band is freed from guide channel 16, the wall portions thereof snapping inwardly into their opened positions, and the band is laid around the goods 10** to be packed.

As can be seen in FIG. 11, the guide channel 16 is provided with a rigid frame 60 connected to housing 12. Rods 61 laterally project from frame 60. These rods have a rail 62 mounted thereon, with two L-shaped flaps 63,64 laterally abutting said rail 62, namely in such a manner that their free legs below rail 62 define a receiving chamber for the band 11. The flaps 63 and 64 are kept pressed against rail 62 by springs 65. When the tension of band 11 increases, the band abuts against the legs of said L-shaped flaps 63 and 64 so that finally the strength of the springs 65 is exceeded and the flaps 63,64 swing into their open positions designated by 63' and 64' so that the band 11 can leave the guide channel 16 in inward direction. The opening movement of valve 63 is detected by a sensor 66 mounted on frame 60 whereupon said sensor 66 switches off the drive branch provided for fast movement and actuates the drive branch for the tensioning process.

After the band has been firmly tied around the packed goods, the abutment plate 38 is laterally withdrawn by cam disk **33*e* while the abutment 20 still remains in its position under band 11. Then, by the action of cam disks 33*c* and 33*b*, clamping jaw 25 and oscillating jaw 26 are pressed downwards, resulting in the condition shown in FIG. 4. A knife 47, mounted on oscillating jaw 26, cuts apart the band at the end of channel 46 of clamping jaw 24. In the overlapping area between the two clamping jaws 24 and 25, the band portions 11*a* and 11*b* lie on top of each other. It is in this overlapping area that oscillating jaw 26 is effective, with the lower band portion 11*a* being held fast on holding face 22 and the upper band portion 11*b* being held fast on the underside of oscillating jaw 26. Then, oscillating jaw 26 is set into oscillating horizontal motion. This is performed by a crankshaft 48 which, by a coupling means 49, is coupled to a permanently rotating shaft 50. Said crankshaft 48 drives oscillating jaw 26 via a crank drive branch 51 so that oscillating jaw 26, while being firmly pressed against upper band portion 11*b*, carries out reciprocating horizontal movements. Thereby, the upper band portion 11*b* is moved relative to the fixedly held lower band portion 11*a***. Within a time period of about a second, the two band portions are welded to each other by frictional heat.

The crankshaft 48 supported in bearings **48*a* is arranged for driving, via a further crank drive branch 52, the clamping jaw 25 which retains upper band portion 11*b*. During this driving action, band portion 11*b* slides on the smooth support face 23 while carried along by the corrugated portion on the underside of clamping jaw 25. Movement of clamping jaw 25 is equiphase with that of oscillating jaw 26 and is carried out with the same amplitude so that the band 11 between clamping jaw 25 and oscillating jaw 26** is not affected by shear movements.

For supporting the clamping jaw 25 while the band is pulled tight, two rollers 53,54 are provided on the housing, which rollers are rotatable about vertical axes and allow the clamping jaw to slide with low friction.

As evident from FIG. 8, the drive rollers 42 and 43 are driven by the first drive branch 70 provided for fast movement whereas the band is tensioned by the second drive branch 71. Both drive branches are driven in common by motor 13 and through a drive belt 72 via pulleys 73 and 74. Each drive branch contains an electromagnetic coupling means 75 or 76, resp. These coupling means are actuated alternately so that at any point of time only one coupling means is switched on. The first drive branch 70 includes, behind coupling means 76, a shaft 77 for driving a pulley 78 and the drive roller 42 tightly connected therewith. Said pulley 78 drives, via belt 44, another pulley 79 being secured for common rotation to drive roller 43 provided for fast reverse. When coupling means 76 is switched on, both drive rollers 42 and 43 are driven. If lever 39 is in the position shown in FIG. 3, band 11 is pressed against drive roller 42 and thus is moved in advance direction. If, however, lever 39 is in the position shown in FIG. 5 wherein band 11 is pressed against drive roller 43, the band is driven in reverse direction.

If sensor 66 is actuated upon opening of guide channel 16 (FIG. 11), the first drive branch 70 is switched off by deactivation of coupling means 76, and the second drive branch 71 is switched on by activation of coupling means 75. Then, coupling means 75 drives a planetary gearing 80 contained in the second drive branch and having its gear housing 81 rotatably supported in housing 12. The planetary gearing 80 is provided, in the usual manner, with a sun wheel connected to the input shaft, planet wheels and, tightly connected to gear housing 81, an inner toothing. The support means of the planet wheels is connected to output shaft 82 which is connected to a free-wheel 83 which, in turn, is connected to pulley 79. The free-wheel 83 has the effect that drive roller 43 can be rotated by the second drive branch 71 without the first drive branch 70 being rotated at the same time via belt 44. Instead of the free-wheel 83, a further switchable coupling could be provided.

The gear housing 81 is connected, by a nonslip drive, i.e. a toothed-belt drive 84, to the output shaft 85 of a holding coupling 86 fixedly arranged in housing 12. Said holding coupling 86 is an electromagnetic brake which holds fast the gear housing 81 via toothed-belt drive 84. As long as gear housing 81 is kept from rotating, the gearing 80, acting as a reduction gear, can transmit the rotation from coupling means 75 to free-wheel 83 and thus to drive roller 43. Since the gearing is a reduction gear, rotation of the drive roller 43 during the tensioning of band 11 is performed at reduced speed. With increasing band tension, the force with which the toothed-belt drive 84 has to hold gear housing 81 against rotation becomes ever larger. When this holding force exceeds the holding force of holding coupling 86, this results in rotation of shaft 85 of holding coupling 86 so that also gear housing 81 is allowed to rotate. Gear housing 81 has attached thereon a disk marker 87 provided as a perforated disk (FIG. 9). The holes in the disk marker 87 are detected by a sensor 88 arranged in a stationary position in housing 12. If sensor 88 detects rotation of disk marker 87 and thus of gear housing 81, a signal can be generated for switching off coupling means 75 and switching on coupling means 34 (FIG. 3), thus moving clamping jaw 25 into its clamping position and carrying out the connecting process. Also, it can be provided that the pulses generated by sensor 88 due to the disk marker 87 are counted and that switching is performed only after the count has reached a predetermined number of pulses.

We claim:

1. A packing machine for wrapping a band (11) around goods (10) to be packed, comprising:

drive means (17) for forming a closed band loop by advancing a band (11) in guide means (16) surrounding the goods to be packed, said drive means (17) including a first drive branch (70) for fast movement and a second drive branch (71) for tensioning the band (11), each of said drive branches (70, 71) being driven by a common drive (13) through selective coupling means (76, 75); control means (34, 39) for switching the drive means (17) to reverse movement and initiating reverse movement of the band (11) after completion of the band loop; sensor means (66) which, if the tension of the band (11) exceeds a limiting value during reverse movement of the band (11), for switching the first drive branch (70) off and switching the second drive branch (71) on; connection means (19) for connecting band portions of the band loop which overlap each other after tensioning; said drive means (17) being provided with a drive roller (42) for advance movement and a drive roller (43) for reverse movement, said drive rollers (42, 43) being driven in common by the respective drive branch (70, 71) being currently in the switched-on state and can be brought alternatively into engagement with the band (11), said control means (34) including a pivotable lever (39) for pressing the band (11) through pressing means (41, 45) selectively against said first drive roller (42) or against said second drive roller (43), said drive rollers (42, 43) rotate in an identical direction, and said band (11) passing between said pressing means (41, 45) and said drive rollers (42, 43) can be pressed with one of its faces against one of the drive rollers (42 or 43) and with the other face against the other drive roller (42 or 43).

* * * * *